US005098164A

United States Patent [19]

Savanick et al.

[11] Patent Number: 5,098,164

[45] Date of Patent: Mar. 24, 1992

[54] ABRASIVE JET MANIFOLD FOR A BOREHOLE MINER

[75] Inventors: George A. Savanick, Apple Valley; Walter G. Krawza, Lakeville; Steven W. Connors, Minneapolis, all of Minn.

[73] Assignee: The United States of America as represented by the Secretary of the Interior, Washington, D.C.

[21] Appl. No.: 642,950

[22] Filed: Jan. 18, 1991

[51] Int. Cl.[5] ..... E21C 45/00

[52] U.S. Cl. ..... 299/17; 175/67; 175/424

[58] Field of Search ..... 299/17, 64; 175/67, 175/424, 315, 313; 166/222, 223

[56] References Cited

U.S. PATENT DOCUMENTS

| | | | |
|---|---|---|---|
| 3,030,086 | 4/1962 | Donaldson et al. | 299/17 X |
| 3,393,013 | 7/1968 | Hammer et al. | 175/67 X |
| 3,439,953 | 4/1969 | Pfefferle | 175/424 X |
| 3,797,590 | 3/1974 | Archibald et al. | 175/67 X |
| 4,401,345 | 8/1983 | Archibald | 299/17 X |
| 4,534,427 | 8/1985 | Wang et al. | 175/424 X |
| 4,708,214 | 11/1987 | Krawza et al. | 175/424 |
| 4,915,452 | 4/1990 | Dibble | 299/17 |

FOREIGN PATENT DOCUMENTS

| | | | |
|---|---|---|---|
| 2571093 | 4/1986 | France | 299/17 |

*Primary Examiner*—Hoang C. Dang
*Attorney, Agent, or Firm*—E. Philip Koltos

[57] ABSTRACT

A manifold for a borehole miner, wherein the manifold is rigidly secured to a first and a second pipe of a pipe bundle; movably connected to at least one other pipe; and provided with a collimating nozzle unit associated with a deflector plate unit, such that a pressurized abrasive jet spray can be directed against the walls of a bore hole, and the back splash from the jet spray will be prevented from adversely affecting the pipes in the pipe bundle by the deflector plate unit.

8 Claims, 1 Drawing Sheet

ABRASIVE JET MANIFOLD FOR A BOREHOLE MINER

TECHNICAL FIELD

The present invention relates to the field of hydraulic borehole mining apparatus in general, and in particular to a cutting head-manifold construction for an abrasive jet borehole miner.

BACKGROUND ART

As can be seen by reference to the following U.S. Pat. Nos. 4,534,427; and 4,708,214; the prior art is replete with myriad and diverse borehole drilling arrangements which employ abrasive fluids to effect the drilling of the strata in the vicinity of the high pressure nozzle.

While all of the aforementioned prior art constructions are more than adequate for the basic purpose and function for which they have been specifically designed, these prior art arrangements have been uniformly deficient with regard to in site mixing of the abrasive and high pressure water spray at the nozzle outlet; as well as providing a mixing manifold immediately downstream of the high pressure outlet; wherein the mixing manifold is designed and configured to cooperate with, yet move independently of the pipe string from which it is suspended and to direct an abrasive jet toward the sidewall of a borehole.

As a consequence of the foregoing situation, there has existed a longstanding need for a rugged cutting head fluid manifold construction that will both cooperate with and serve to protect a conventional pipe string arrangement and to direct an abrasive jet toward the sidewall of a borehole and the provision of such a construction is a stated objective of the present invention.

DISCLOSURE OF THE INVENTION

Briefly stated, the cutting head manifold construction that form the basis of the present invention comprises a fluid mining manifold housing unit mounted on a support bracket unit equipped with a back spray deflector unit and a collimating nozzle unit.

Borehole mining, also known as slurry mining, is a process in which a tool incorporating a water jet cutting system and a downhole slurry pumping system are used to mine ore through a single borehole drilled from the surface to the buried ore. Water jets from the mining tool erode the ore and form a slurry. The slurry flows into the inlet of a pump in the base of the tool. The slurry is lifted to the surface where it can be transferred by a pipeline to a processing plant.

The abrasive jet borehole miner, of this invention integrates an abrasive jet cutter with a downhole slurry pump. It is in the form of an assembly which is suspended in a well and rotated by a turntable at the wellhead. This assembly consists of a bundle of four pipes. The first pipe supplies pressurized water (10,000 psi, 20 gpm) to a nozzle in a cutting head. The second pipe supplies abrasive to a mixing chamber downstream of the nozzle. The third pipe supplies water to a nozzle in a downhole eductor used as a slurry pump; and, the fourth pipe is the outlet for the downhole slurry pump.

As will be explained in greater detail further on in the specification, the cutting head manifold construction is designed to be operatively connected to the first two pipes and slideably disposed relative to the third and fourth tubes; wherein, the shield unit is designed and intended to deflect the high pressure abrasive spray emanating from the collimating nozzle unit from impinging on the surfaces of the third and fourth pipe closes to the collimating nozzle outlet.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 3:
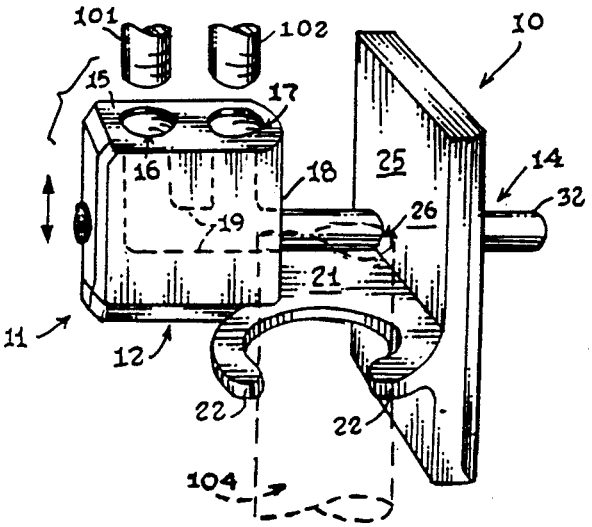
FIG. 3 is a perspective view of the abrasive jet manifold.

As can be seen by reference to the drawings, and in particular to FIG. 3, the cutting head manifold that forms the basis of the present invention is designated generally by the reference numeral (10). The manifold (10) comprises in general: a manifold housing unit (11); a support bracket unit (12); a spray deflector unit (13); and, a collimating nozzle unit (14). These units will be described in seriatim fashion further on in the specification.

Prior to embarking upon a detailed description of the cutting head manifold construction (10) it would first be advisable to briefly describe the environment in which this invention is to be employed.

Figure 1:
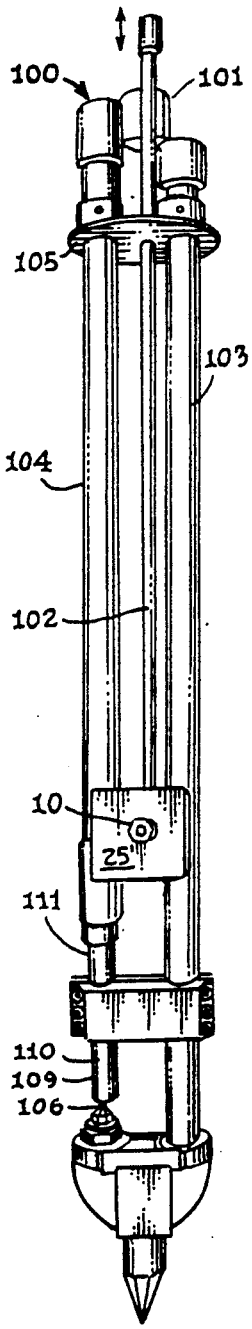
FIG. 1 is a front schematic view of an abrasive jet borehole miner.
Figure 2:
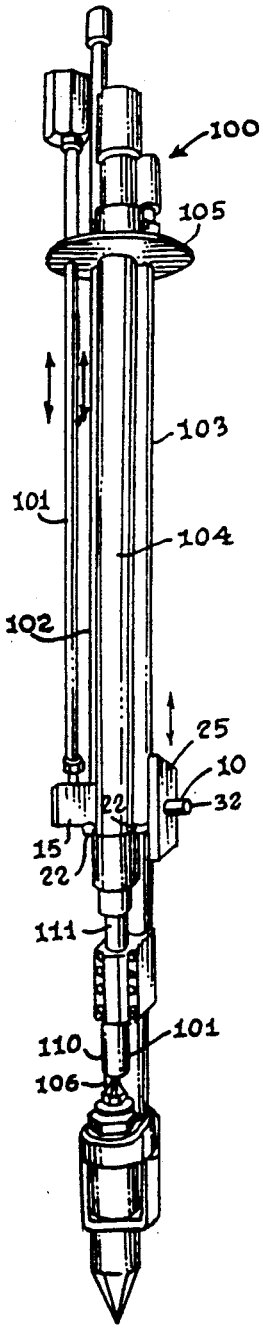
FIG. 2 is a side schematic view of the borehole miner.

As mentioned previously and as can be seen by reference to FIGS. 1 and 2 the basic abrasive jet borehole miner with which the cutting head manifold construction (10) is employed is designated generally by reference numeral (100). The borehole miner (100) comprises in general a first pipe (101) which supplies pressurized water and a second pipe (102) which supplies abrasive which are to be mixed in the manifold construction (10).

In addition the borehole miner (100) further comprises a third pipe (103) which supplies water to a downhole inductor (111) which comprises a nozzle (106) which injects a water jet into a mixing section (109) and a diffuser (110) of the eductor (111) which functions as a slurry pump. The slurry in the borehole is induced to flow into the inlet of the eductor (111) by the Venturi effect to mix with the water jet in the mixing section (109) and then pass through the diffuser (110) into the fourth pipe (104) which forms the last pipe of the pipe bundle.

Furthermore the borehole miner (100) also comprises a collar (105) which rigidly suspends the third (103) and fourth (104) pipes of the pipe bundle in the borehole; while the collar (105) is adapted to movably accommodate both the first (101) and the second pipes in the vertical plane as indicated by the directional arrows.

Turning now to FIG. 3 it can be seen that the cutting head manifold housing unit (11) comprises a housing member (15) provided with a plurality of interconnected fluid ports wherein the top of the housing member (15) is provided with a pair of inlet ports (16) and (17) which are dimensioned to accommodate the outlets of the first (101) and second (102) pipes respectively for reasons that will be explained presently.

Figure 4:
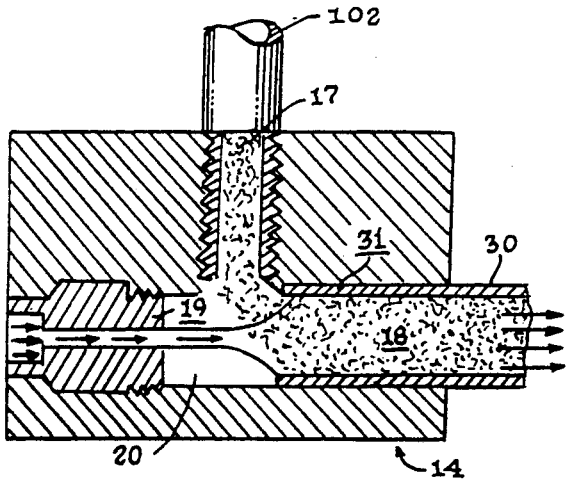
FIG. 4 is an isolated detail view of the venture mixing chamber in the manifold.

In addition as can be seen in FIGS. 3 and 4 the inlet ports (16) and (17) are in open fluid communication with one another via an outlet part (18) which projects through the side of the housing member (15). Furthermore a restrictor plate nozzle element (19) is disposed intermediate the inlet ports (16) and (17) to form a mixing chamber (20), wherein, the highly pressurized water (approximately 10,000 psi, 20 gpm) issuing from the nozzle element (19) creates a venturi effect which causes a pressure drop that induces abrasive to flow from the second pipe (102) into the mixing chamber (20) where the abrasive is entrained in the water jet.

Turning once more to FIG. 3, it can be seen that the housing member (15) is rigidly secured to the support bracket unit (12); wherein, the support bracket unit (12) comprises a contoured generally horizontal support plate (21) having at least one pair of arm members (22) which are dimensioned to slideably engage the periphery of one of the stationary tubes (103) (104) of the pipe bundle for reasons that will be explained presently.

As can also be seen by reference to FIG. 3, the deflector plate unit (13) comprises an enlarged vertically disposed back-splash deflector plate member (25) which is secured on the outboard end of the horizontal support plate (21) at a location spaced from the housing member (15); wherein, the deflector plate member (25) projects a substantial distance both above and below the support plate (21). Furthermore, the deflector plate member (25) is also provided with an aperture (26) which is generally aligned with the outlet port (18) in the housing member (15).

As shown in FIGS. 3 and 4, the collimating nozzle unit (14) comprises a collimating nozzle member (30) which is dimensioned to be received on one end (31) in the outlet port (18) of the housing member (15), extend through the aperture (26) in the deflector plate member (25) and have the other end (32) project beyond the face (25') of the deflector plate member (25).

By now it should be appreciated that the manifold (10) of the invention is intended to be rigidly secured to the moveable pipes (101), (102) of the pipe bundle and slidably disposed on at least one of the two stationary pipes (103), (104); whereby the manifold (10) can be vertically displaced within the borehole and rotated by the turntable to direct the pressurized jet at selected locations within the borehole to cut hard rock and other substances.

In addition, the deflector plate element (25) is dimensioned and disposed relative to the remainder of the manifold (10) and the portion of the stationary pipes (103), (104) in the vicinity of the outlet of the collimating nozzle member (30) that any high pressure low angle back-splash will be prevented from adversely impacting on the stationary pipes (103), (104).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

We claim:

1. A manifold for a borehole miner which includes a bundle of pipes in a borehole operatively connected to a turntable, wherein the bundle of pipes includes a first pipe containing pressurized water; a second pipe containing abrasive, and at least one other pipe, wherein the first and second pipes are movable as a unit relative to both said turntable and said at least one other pipe, and said manifold comprises:

a manifold housing unit having a pair of inlet ports and an outlet port in open fluid communication with said inlet ports, wherein said inlet ports are operatively connected to said first and second pipes;

a support bracket unit rigidly secured to said housing unit, wherein said support bracket unit is operatively engaged with and movably associated with respect to said at least one other pipe; and a spray deflector unit operatively associated with said support bracket unit, wherein said spray deflector unit comprises an enlarged deflector plate member which projects above and below said support bracket unit; wherein the outlet port of said manifold housing unit is in open fluid communication with the front face of said enlarged deflector plate member.

2. The manifold as in claim 1, wherein said manifold housing unit further includes:

a restrictor plate nozzle element disposed intermediate said pair of inlet ports.

3. The manifold as in claim 1, wherein said support bracket unit further includes:

a pair of arm members dimensioned to slideably engage said at least one other pipe.

4. The manifold as in claim 1, further comprising:

a nozzle unit including a collimating nozzle member having one end operatively connected to the outlet in said housing unit.

5. The manifold as in claim 4, wherein said deflector plate member is provided with an aperture dimensioned to receive said collimating nozzle member.

6. The manifold as in claim 5, wherein said deflector plate member is spaced from the outlet of said manifold housing unit.

7. The manifold as in claim 6, wherein said collimating nozzle member is dimensioned to be received in the aperture in said deflector plate member.

8. The manifold as in claim 7, wherein the other end of said collimating nozzle member projects beyond said deflector plate member.

* * * * *